US008222196B2

(12) United States Patent
Smith et al.

(10) Patent No.: US 8,222,196 B2
(45) Date of Patent: Jul. 17, 2012

(54) COMPOSITION AND METHODS FOR REMOVAL OF POLYMERIZED NON-TRANS FATS

(75) Inventors: Kim R. Smith, Woodbury, MN (US); Yvonne M. Killeen, South St. Paul, MN (US); Victor F. Man, St. Paul, MN (US); Keith Olson, Apple Valley, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 12/617,121

(22) Filed: Nov. 12, 2009

(65) Prior Publication Data

US 2011/0112004 A1 May 12, 2011

(51) Int. Cl.
*C11D 3/37* (2006.01)

(52) U.S. Cl. ..... 510/238; 510/109; 252/140; 252/156; 252/174

(58) Field of Classification Search ..... 510/238, 510/109; 252/174, 156, 140
See application file for complete search history.

(56) References Cited

U.S. PATENT DOCUMENTS

| | | | | |
|---|---|---|---|---|
| 2,674,619 | A | 4/1954 | Lundsted | |
| 2,677,700 | A | 5/1954 | Jackson et al. | |
| 2,903,486 | A | 9/1959 | Brown et al. | |
| 3,048,548 | A | 8/1962 | Martin et al. | |
| 3,382,178 | A | 5/1968 | Lissant et al. | |
| 3,664,961 | A | 5/1972 | Norris | |
| 3,929,678 | A | 12/1975 | Laughlin et al. | |
| 4,363,756 | A | 12/1982 | Sepulveda et al. | |
| 4,565,647 | A | 1/1986 | Llenado | |
| 4,877,691 | A | 10/1989 | Cockrell, Jr. | |
| 4,909,962 | A | 3/1990 | Clark | |
| 5,137,793 | A * | 8/1992 | Cockrell, Jr. | 428/688 |
| 5,389,138 | A * | 2/1995 | Harry, Jr. | 106/287.14 |
| 5,407,700 | A | 4/1995 | Man et al. | |
| 6,156,716 | A * | 12/2000 | Ahmed | 510/272 |
| 6,180,592 | B1 | 1/2001 | Smith et al. | |
| 6,503,879 | B2 * | 1/2003 | Lentsch et al. | 510/446 |
| 2005/0192197 | A1 * | 9/2005 | Man et al. | 510/375 |
| 2005/0197277 | A1 * | 9/2005 | Gallagher et al. | 510/475 |
| 2009/0264329 | A1 * | 10/2009 | Underwood et al. | 510/109 |

* cited by examiner

*Primary Examiner* — Mark Eashoo
*Assistant Examiner* — M. Reza Asdjodi
(74) *Attorney, Agent, or Firm* — McKee, Voorhees & Sease, P.L.C.

(57) ABSTRACT

The invention is a composition and method for removing soils containing polymerized non-trans fats from surfaces. The composition comprises a polymer and sequentrant, wherein the polymer is oleophobic and hydrophilic. Optionally, the composition may also include a wetting agent. The composition may be used by applying it to a clean surface as a pretreatment so that when said surface is soiled or contaminated with polymerized non-trans fats it may be easily removed with water.

20 Claims, No Drawings

COMPOSITION AND METHODS FOR REMOVAL OF POLYMERIZED NON-TRANS FATS

FIELD OF THE INVENTION

The invention relates to a pretreatment soil release composition and methods for using a pretreatment soil release composition for polymerized non-trans fats. In particular, the soil release composition removes non-trans fat soils without the need for cleaning products.

BACKGROUND OF THE INVENTION

Due to a variety of health-related concerns, the food industry has made a significant shift towards utilizing non-trans fat sources in place of trans fats or to minimize the amount of trans fats used in production of food products. The health benefits of consuming fewer trans fats are well established. However, the replacement of trans fats with non-trans fats poses new concerns over the need and ability to clean and remove such soils from a variety of surfaces. Non-trans fat oils and other soils form thickened liquid, semi-solid or solid soils on a variety of surfaces, presenting a need for more effective cleaning compositions and methods. Additionally, the non-trans configuration of these soils, namely its thermal stability, presents unique concerns for the need to clean surfaces soiled with non-trans fats.

There remains a significant need for improved methods and compositions for treating non-trans fat soils due to the increased use of such fat sources in the food industry. Cleaning compositions known in the art often require caustic compounds and repeated treatments each time a surface is soiled with a non-trans fat. Therefore, there is a need for compositions and methods which more effectively remove non-trans fat soils. Products capable of causing the non-trans fat soil to bead from surfaces and water to sheet off of the treated surfaces are highly desirable.

Accordingly, it is an objective of the claimed invention to develop methods and compositions for pretreating clean surfaces soiled with non-trans fats.

A further object of the invention is a prevent the need for additional cleaning products or repeated use of a cleaning product for non-trans fat soils on a variety of surfaces.

A further object of the invention is a cleaning composition effective as a pretreatment of clean surfaces to form a layer to protect a surface from non-trans fat soils.

A further object of the invention includes methods and compositions for pretreatment of surfaces contacting non-trans fats that prevent the need for cleaning products once the surface is soiled.

BRIEF SUMMARY OF THE INVENTION

A soil release composition for pretreating surfaces frequently soiled with non-trans fats is provided according to the invention. Methods of using the same soil release composition for pretreatment cleaning are further provided according to the invention. The soil release composition includes a polymer and sequestrant and optionally a wetting agent.

DETAILED DESCRIPTION OF THE PREFERRED EMBODIMENT

The embodiments of this invention are not limited to particular pretreatment methods and compositions for such pretreatment methods for non-trans fat sources, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The soil release compositions and methods of using the compositions according to the embodiments of the invention present a significant improvement in the prior art and represents a significant change in the cleaning industry. The soil release compositions and methods of the invention obviate the need for cleaning compositions for surfaces soiled with non-trans fat oils which have been pretreated with the soil release composition of the present invention. Accordingly, clean surfaces pretreated with the soil release composition no longer necessitate the need for use of cleaning products once a surface is soiled, which most often remove soils by dissolving an organic soil in a large proportion of solvent or use highly alkaline or caustic treatments posing safety concerns. Rather, a layer of a soil release composition is added to a clean surface prior to being soiled with a non-trans fat soil and thereby negates the need for other cleaning materials common in the industry for cleaning hard surfaces, such as for use in household and institutional applications, etc. Such traditional cleaning products and methods are often expensive, require significant labor and pose safety concerns; accordingly, the soil release compositions and methods of the invention result in significant savings and reduction of labor when the soil release compositions are utilized as surface pretreatments as soils may be removed with water and/or a cleaning article to clean a surface after it is soiled.

According to an embodiment of the invention a soil release composition is described for use as a pretreatment for clean hard surfaces. The compositions and methods according to the invention may be utilized to pretreat a variety of surfaces, including for example metal surfaces. Preferably, a clean stainless steel surface is pretreated with the soil release composition of the invention. The composition serves as a soil release layer for polymerized food soils, in particular for polymerized non-trans fats such as corn oil or soybean oil. According to alternative embodiments of the invention, the soil release composition and methods provided herein may be utilized in a variety of settings, including: institutional, such as for cleaning ovens, grills, smoke stacks, floors surrounding or adjacent to greasy food areas, countertop surfaces such as steel, stainless steel, metal, ceramic, etc.; laundry; food and beverage services, including food processing plants and various floor surfaces; and/or vehicle care, including soil release from cars and car parts and wax removal form cars and car parts.

According to a preferred embodiment of the invention, the soil release composition used as a pretreatment for clean surfaces comprises of a polymer and a sequentrant. According to a further embodiment of the invention, the soil release composition comprises a polymer, sequentrant and wetting agent. The compositions of the preferred pretreatment soil release compositions may be described using a 100% solids basis for components. Preferred compositions comprise from about 1-10% polymer, 0.5-10% sequestrant and 0-5% wetting agent; more preferably from about 2-8% polymer, 1-7% sequestrant and 0.1-3% wetting agent; and still more preferably from about 2-4% polymer, 2-5% sequestrant and 0.2-2% wetting agent. These percentages can refer to percentages of the commercially available soil release composition, which can further contain solvents, dyes, odorants, colorants and the like in addition to the polymer, sequestrant and optionally the wetting agent of the soil release composition.

The polymer of the soil release composition may be of any structure to be compatible with the soil release composition and effective according the methods of the present invention. However, according to an embodiment of the invention, a preferred polymer is both oleophobic to lack an affinity for oils and hydrophilic to attract to water in order to cause non-trans fats, such as unpolymerized vegetable oil, to bead from a pretreated soiled surface. The polymer of the soil release composition causes the beading of the oil as well as slowing down the polymerization of the oil to ensure that the oil remains in a liquid state, rather than polymerizing to a solid form that is more difficult to treat and clean from a surface. The preferred oleophobic and hydrophilic polymer will also cause water to sheet on a pretreated soiled surface, minimizing any water stains on the treated surface. Polymers according to the soil release composition may include for polyacrylates (Rohm & Haas, Acusol 445 and Acusol 448), olefin/maleic copolymers (Rohm & Haas, Acusol 460), and polycarboxylates, such as modified polycarboxylates (BASF Corp., ES#8804). Preferably, the polymer is non-thickening and does not contribute to an increase in viscosity of the system.

According to a preferred embodiment of the invention, the contact angle of the non-trans fat, such as vegetable oil, is greater than 20 degrees, preferably greater than 30 degrees, and the ratio of oil/water contact angle is greater than 2.0 to ensure that both the oil will bead from a pretreated soiled surface and the water will sheet-off the pretreated soiled surface to minimize water spotting on the surface.

According to a further embodiment of the invention, the polymers of the soil release composition may be used over a wide range of pH of about 1-14, preferably from about 3-12, and most preferably from about 5-11. Due to the polymer's ability to be utilized under such variable pH depending primarily upon the formulation choice, use of acidulants and/or alkaline agents to maintain the appropriate pH for the soil release compositions may be necessary as one of ordinary skill in the art would be able to recognize and implement. The acidic component or acidulant used to prepare the final soil release composition of the invention will comprise an acid which can be dissolved in the aqueous system of the invention to adjust the pH downward. Preferably, common commercially-available weak inorganic and organic acids can be used in the invention, including for example phosphoric acid, sulfamic acid, acetic acid, hydroxyacetic acid, citric acid, tartaric acid and numerous other acidulants. Alkaline materials that can be used for pH adjustment of the soil release composition may include both weak and strong alkaline materials, including for example sodium hydroxide, potassium hydroxide, alkali metal salts such as sodium carbonate, potassium carbonate, sodium bicarbonate, potassium bicarbonate, sodium sesquicarbonate, sodium borate, potassium borate, sodium phosphate, and potassium phosphate, organic bases such as triethanolamine, tripropanolamine, etc., alkali metal silicates, alkali metal salts generally and numerous other alkaline agents.

According to an alternative embodiment of the invention, the polymer of the soil release composition may both serve as the soil beading agent and an iron sequestrant, replacing or supplementing a sequestrant of the soil release composition. According to an alternative embodiment, methacrylates and related copolymers are preferred polymers having an iron stability constant of about 5. Additionally, polyacrylates and related copolymers are also effective as sequestrants in addition to polymers capable of beading non-trans fat sources, including for example, Acusol 445 and Acusol 448 (Rohm & Haas) and the sodium polyacrylate Sokalan PA15 (BASF Corp.).

The sequestrant of the soil release composition is a chelating agent or combination of agents capable of hindering or reducing the polymerization of the non-trans fats. The sequestrant of the composition is also a chelating agent capable of hindering metal complexation by forming chelate complexes with metal ions. Non-trans fat oils contain heavy metal ions that act as oxidative catalysts in the polymerization of the oils; further, the cooking process of non-trans fat oils also results in the addition of heavy metal ions, due to the oils often being cooked in metal surfaces (e.g. metal pots and pans). Accordingly, the sequestrant of the soil release composition must be capable of chelating the metal ions of the non-trans fat soil on the pretreated surface to relieve the heavy metals as well as hinder polymerization of the non-trans fat soils the pretreated surface according to the methods of the invention.

The discovery of the link between non-trans fats and laundry fires (see U.S. Patent Application No. 61/243,634) resulted in compositions for treating non-trans fats soils. Due to the significant risk of thermal polymerization resulting in fires, compositions preventing the polymerization of non-trans fats are needed to prevent such risk of fires and represent ideal compositions for cleaning non-trans fat soiled surfaces. Polymerization of non-trans fats results from the unsaturated bonds of the fats, generating significant amounts of heat. The higher energy state of the trans configuration causes heat from one double bond to heat the next double bond, resulting in a chain reaction. U.S. Patent Application No. 61/243,634 demonstrated the inclusion of a chelating agent to reduce heavy metals in surfaces soiled with non-trans fats (namely textiles) such as soybean oil, to impede polymerization of the non-trans fats, resulting in a reduction of spontaneous combustion.

According to a preferred embodiment of the invention, the sequestrant of the soil release composition has a stability constant with iron ligands of at least about 5. The preferred sequestrant is a chelating agents characterized by a strong chelating character as quantified by the stability constant with iron ligands. The stability constant provides a measure of relative chelation strength. According to a preferred embodiment of the invention, the stability constant with iron ligands is more preferably greater than 8, and still more preferably greater than 10. Citrate is a potential sequestrant for the soil release composition as it has an iron stability constant of about 5. Preferred sequestrants for the soil release composition are aminocarboxylates, having iron stability constants of about from 8 to greater than 10.

According to additional embodiments of the invention, organic sequestrants may be used for the soil release compositions. Organic sequestering and chelating agents include both polymeric and small molecule agents. The polymeric sequestrants commonly include polyanionic compositions, such as polyacrylic acid compounds. Organic small molecule agents include organocarboxylate compounds or organophosphate agents. Exemplary small molecule organic agents include ethylenediaminetraacetic acid (EDTA), diethylenetriaminepentaacetic acid (DTPA), N-hydroxyethylenediaminetriacetic acid (HEDTA), nitrilotriaacetic acid (NTA), methylglycinediacetic acid (MGDA), tetrasodium L-glutamic acid, N,N-diacetic acid (GLDA), triethylenetetraaminehexaacetic acid (TTHA), and the respective alkali metal, ammonium and substituted ammonium salts thereof.

Phosphates and aminophosphonates are also suitable for use as sequestrants of the soil release composition, including ethylenediaminetetramethylene phosphonates, nitrilotrismethylene phosphonates, 1-hydroxy ethylidene-1,1-diphosphonates, diethylenetriamine-pentamethylene phosphonate, and 2-phosphonobutane-1,2,4-tricarboxylates, for example. Alternative suitable sequestrants include water soluble polycarboxylate polymers, including homopolymeric and copolymeric agents such as polymeric compositions with pendant (—CO 2 H) carboxylic acid groups, including polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers or copolymers such as their respective alkali metal or ammonium salts may also be used. The weight average molecular weight of the polymers is from about 4000 to about 12,000.

The optional wetting agent of the soil release composition are surfactant agents that are amphiphilic, containing hydrophobic and hydrophilic groups to allow solubility in both water and organic solvents. According to embodiments of the invention, optional wetting agents preferably include surfactants or surfactant admixtures selected from water soluble or water dispersible nonionic, semi-polar nonionic, anionic or any combination thereof. A representative listing of the classes and species of surfactants as may be useful herein for the soil release composition appears in U.S. Pat. No. 3,664,961. The particular surfactant or surfactant mixture chosen depends upon the conditions of the final utility of the soil release composition, including for example the method of manufacture, physical product form, use pH, use temperature, foam control and soil type.

According to a preferred embodiment of the invention, wetting agents may be either nonionic or anionic surfactants or mixtures of the surfactants. Use of such nonionic or anionic surfactants as wetting agents of the soil release compositions ensures compatibility with the polymers of the composition. Additionally, nonionic or anionic surfactants are desirable in soil release composition because of its wetting and detersive properties and the variety of commercially-available surfactants available in the cleaning industry that may be utilized according to the invention. Most preferred embodiments of the soil release composition include nonionic surfactants as the wetting agent, preferably EO-PO (ethylene oxide-propylene oxide) copolymers, and still more preferably a reverse EO-PO copolymer.

Nonionic surfactant are most generally characterized by the presence of an organic hydrophobic group and an organic hydrophilic group typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. (U.S. Pat. No. 3,929,678; Nonionic Surfactants, edited by Schick, M. J., Vol. 1 of the Surfactant Science Series, Marcel Dekker, Inc., 1983). Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Additional examples of nonionic surfactants are described by Schwartz et al., Surface Active Agents and Detergents, Volumes I-II (year).

According to the invention, useful nonionic surfactants include block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® (BASF Corp.). Pluronic® compounds are difunctional (two reactive hydrogens) compounds formed by condensing ethylene oxide with a hydrophobic base formed by the addition of propylene oxide to the two hydroxyl groups of propylene glycol. The hydrophobic portion of the molecule weighs from about 1,000 to about 4,000 (MW). Ethylene oxide is then added to combine the hydrophobe between the two hydrophilic groups, controlled by length to constitute from about 10% by weight to about 80% by weight of the final molecule. The Tetronic® compounds are tetra-functional block copolymers derived from the sequential addition of propylene oxide and ethylene oxide to ethylenediamine. The molecular weight of the propylene oxide hydrotype ranges from about 500 to about 7,000 (MW); and, the hydrophile, ethylene oxide, is added to constitute from about 10% by weight to about 80% by weight of the molecule.

According to the invention, additional useful nonionic surfactants include condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. According to a further embodiment of the invention, additional useful nonionic surfactants include condensation products of one mole of saturated or unsaturated, straight or branched chain carboxylic acid having from about 8 to about 18 carbon atoms with from about 6 to about 50 moles of ethylene oxide. According to additional embodiments of the invention of the soil release composition, additional useful nonionic surfactants may include low foaming surfactants include compounds modified, essentially reversed, by adding ethylene oxide to ethylene glycol to provide a hydrophile of designated molecular weight; and, then adding propylene oxide to obtain hydrophobic blocks on the outside (ends) of the molecule. Additional examples of alternative nonionic surfactants include: low-foaming or defoaming nonionic surfactants such as those disclosed in U.S. Pat. Nos. 2,903,486, 3,048,548, 3,382,178, 2,677,700, 2,674,619; noninonic surfactants disclosed in U.S. patent application Ser. No. 61/243,634; conjugated polyoxyalkylene surface-active agents; polyhydroxy fatty acid amide surfactants; alkyl ethoxylate condensation products of aliphatic alcohols; ethoxylated C6-C18 fatty alcohols and C6-C18 mixed ethoxylated and propoxylated fatty alcohols; nonionic alkylpolysaccharide surfactants, such as those disclosed in U.S. Pat. No. 4,565,647; fatty acid amide surfactants; alkoxylated amines or, most particularly, alcohol alkoxylated/aminated/alkoxylated surfactants; and semi-polar nonionic surface active agents disclosed in U.S. patent application Ser. No. 61/243,634, including amine oxides, phosphine oxides, sulfoxides and their alkoxylated derivatives.

In addition to the nonionic surfactants useful as wetting agents for the soil release composition according to the invention, anionic surfactants can also be used as surfactants. According to an alternative embodiment, the nonionic surfactants can be used in combination with anionic surfactants. According to a still further embodiment of the invention, anionic surfactants are utilized as the wetting agent for the soil release composition. Anionic agents have either a negative charge on the hydrophobe or the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. Skilled artisans understand that anionic compounds are excellent detersive surfactants. Accordingly, anionic surfactants may be used as the wetting agent for the soil release composition of the invention. Examples of the various suitable anionic surfactants are described in Surface Active Agents and Detergents, Vols. I-II by Schwartz et al. and disclosed in U.S. Pat. No. 3,929,678.

The majority of large volume commercial anionic surfactants can be subdivided into five major chemical classes and additional sub-groups known to those of skill in the art. (Surfactant Encyclopedia, Cosmetics & Toiletries, Vol. 104(2): 71-86 (1989)). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. The numerous examples the various types of surfactants are merely illustrations of the numerous surfactants which can find application within the scope of this invention. The nonionic and/or anionic surfactants preferred according to the invention can be formulated into any of the several commercially-desirable composition forms for the soil release composition of this invention to have utility as a pretreatment for surfaces that become soiled with non-trans fats.

The various embodiments of the soil release composition of the invention are utilized for pretreating a clean surface, wherein the soil release compositions are used to pretreat clean surfaces, for example surfaces used for food preparation or other commonly-soiled surfaces. The composition for pretreating a clean surface may be provided in concentrated form which, when dispensed or dissolved in water, properly diluted by a proportionating device, and delivered to the target surfaces as a solution, gel or foam will provide pretreatment of a clean surface. For example, the soil release composition of the invention may be provided in a concentrate of liquid or emulsion. According to additional embodiments of the invention, the soil release composition may further be used as a foam, liquid, paste and/or concentrate.

According to a further embodiment of the invention, the soil release composition may be formulated to further include other optional agents to the composition in conventional levels. For example, it may be desirably to include cleaning enhancement agents, diluents, solvents, thickening agents, processing aids, corrosion inhibitors, dyes, fillers, optical brighteners, antimicrobials, odorants and the like. It may be further desirable to add additional agents for specialized uses of a surface. For example, use of the soil release composition for the pretreatment of floors or other surfaces requiring slip resistant conditions, may require the addition of etchants or other additives to obtain and maintain an optimum static coefficient of friction (traction).

According to one embodiment of the invention, the soil release composition may further comprise cleaning enhancement agents, including for example sulfite- and peroxygen-based compounds. In some embodiments, sulfite sources are included, such as water soluble salts of sulfite ion (SO3-2), bisulfite ion (HSO3-), meta bisulfite ion (S2O5-2) and hydrosulfite ion (S2O4-2) and mixtures thereof. In other embodiments, peroxygen compounds are included. Peroxygen compounds include, but are not limited to, hydrogen peroxide, peroxides and various percarboxylic acids, including percarbonates, can be used with the methods of the present invention. Peroxycarboxylic (or percarboxylic) acids generally have the formula R(CO3H)n, where, for example, R is an alkyl, arylalkyl, cycloalkyl, aromatic, or heterocyclic group, and n is one, two, or three, and named by prefixing the parent acid with peroxy. The R group can be saturated or unsaturated as well as substituted or unsubstituted. Medium chain peroxycarboxylic (or percarboxylic) acids can have the formula R(CO3H)n, where R is a C5-C11 alkyl group, a C5-C11 cycloalkyl, a C5-C11 arylalkyl group, C5-C11 aryl group, or a C5-C11 heterocyclic group; and n is one, two, or three. Short chain perfatty acids can have the formula R(CO3H)n where R is C1-C4 and n is one, two, or three.

Exemplary peroxycarboxylic acids for use with the present invention include, but are not limited to, peroxypentanoic, peroxyhexanoic, peroxyheptanoic, peroxyoctanoic, peroxynonanoic, peroxyisononanoic, peroxydecanoic, peroxyundecanoic, peroxydodecanoic, peroxyascorbic, peroxyadipic, peroxycitric, peroxypimelic, or peroxysuberic acid, mixtures thereof, or the like. Branched chain peroxycarboxylic acids include peroxyisopentanoic, peroxyisononanoic, peroxyisohexanoic, peroxyisoheptanoic, peroxyisooctanoic, peroxyisonananoic, peroxyisodecanoic, peroxyisoundecanoic, peroxyisododecanoic, peroxyneopentanoic, peroxyneohexanoic, peroxyneoheptanoic, peroxyneooctanoic, peroxyneononanoic, peroxyneodecanoic, peroxyneoundecanoic, peroxyneododecanoic, mixtures thereof, or the like. Additional exemplary peroxygen compounds include hydrogen peroxide (H2O2), peracetic acid, peroctanoic acid, a persulphate, a perborate, or a percarbonate. In some embodiments, the active oxygen use solution cleaning composition comprises at least two, at least three, or at least four active oxygen sources. In other embodiments, the cleaning composition can include multiple active oxygen sources, for example, active oxygen sources that have a broad carbon chain length distribution. In another embodiment, combinations of active oxygen sources for use with the methods of the present invention can include, but are not limited to, peroxide/peracid combinations, and peracid/peracid combinations. In other embodiments, the active oxygen use solution comprises a peroxide/acid or a peracid/acid composition.

According to an embodiment of the invention, the soil release composition may further comprise a diluent or mixture of diluents. According to one embodiment of the soil release composition invention, the composition may be formulated in a concentrated form requiring it to be diluted with water to a desired concentration at the intended use location. As a skilled artisan would recognize, ordinary tap water, softened water or process water may be employed. The composition concentrates and various dilutions of these concentrates (typically can be used at full strength concentrate down to a 1:100 concentrate:water dilution) can be used as a pretreatment for surfaces that will be soiled with polymerized non-trans fat soils. A variety of mixing methods may be employed (such as automated or manual dilutions) and various levels of additives, such as thickening agents, can be mixed in with the diluted composition depending on the specific needs of the cleaning operation.

In addition to the compositions of soil release agents according to the invention, preferred methods of applying the soil release composition to suitable clean surfaces are provided. The soil release compositions are suitable for pretreatment of such clean surfaces. According to an embodiment, the composition is applied to a clean surface, such as a metal surface surrounding areas utilized for food preparation, for a sufficient period of time to dry on such surface. According to an embodiment of the invention, once the surface is soiled with a non-trans fat oil or other soil source, the surface may then be wiped clean with a wet cloth or other cleaning article without the need for applying any additional cleaning compositions. The pretreated soiled surface may alternatively be washed with water alone to remove the soiled non-trans fats from the surface. The pretreated soiled surface may easily be cleaned according to these embodiments of the invention, resulting in the loosening and removal of non-trans fat oils or other soils from the hard surface. A significant benefit of the methods and soil release composition is the unexpected benefit of having daily pretreatment application lasting for repeated soils with non-trans fats. Accordingly, a daily use of the soil release composition can provide a layer of protection on top of the pretreated surface (forming a physical barrier), preventing the need for cleaning compositions through the day. For example, according to a preferred embodiment, a surface may be treated with the soil release composition in the evening and allowed to dry overnight, obviating the need for cleaning products the following day in spite of repeated soils with various non-trans fat sources.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

The effect of combining a sequestrant and oleophobic polymer were tested according to the methods and compositions of the invention. A stainless steel panel was divided into four sections and was pretreated with either a control, an oleophobic polymer, a sequestrant or a combination of polymer and sequestrant. No pretreatment was applied to one section (Test One: Control). A 10% solution of a 40% solids solution of a proprietary modified polycarboxyate (Test Two: BASF ES#8804) was applied to a second section. A 5% solution of a 40% solids sodium DTPA (Test Three: Additive D) was applied to a third section. The fourth section was treated with a combination of a 10% solution of a 40% solids solution of modified polycarboxyate (BASF ES#8804) combined with 5% solution of a 40% solids sodium DTPA solution (Additive D) (Test Four: ES#8804 plus Additive D).

Each section of the stainless steel panel was wetted with the solutions and then allowed to air dry over about a 5 minute period. Corn oil (i.e. vegetable oil) was then wiped onto the entire panel which was then baked in an air convection oven at 400° F. for 15 minutes. After baking the panels with the pretreated corn oil soil, the vegetable oil polymerized to form a hard film on all sections of the stainless steel panels. The surfaces were then cleaned using only a paper towel and water. Only the combination of the modified polycarboxyate polymer (BASF ES#8804) with sodium DTPA section (Test Four) was able to be cleaned substantially free of the corn oil soil using the water and paper towel. Water flow alone was unable to remove the corn oil soil from any of the four stainless steel panels.

Example 2

The effect of cleaning surfaces soiled with non-trans fat with water flow alone were tested according to the methods and compositions of the invention. A stainless steel panel was divided into two sections. The first section was not administered a pretreatment (Test One: Control). The second was administered a pretreatment consisting of the combined polymer/DTPA utilized in Example 1 with a surfactant. The surfactant added to the oleophobic polymer and sequestrant was 0.2% Pluronic 10R5 (Test Two: 22D). The pretreatment was sprayed on the stainless tell panel and allowed to air dry. Corn oil was then wiped onto the entire panel which was then heated on a hotplate until the control section had polymerized to a hard dark gold soil. The hot coupon was then held under a flow of ambient temperature water.

The flow of water alone resulted in essentially complete loss of the polymerized soil on the Test Two surface where the pretreatment consisting of a polymer, sequestrant and surfactant was added before the corn oil soil. No loss of soil was observed from the Test One control surface.

Example 3

Using the methods of Example 2, various pretreatment compositions were compared for soil release of polymerized corn oil from a steel surface. Suitable sequestrants utilized in this testing included aminocarboxylates (EDTA, DTPA), hydroxycarboxylates (sodium citrate), organophosphonates (Dequest 2010). Suitable polymers utilized in this testing included polyacrylates (Acusol 445 and Acusol 448), olefin/maleic copolymers (Acusol 460), and modified polycarboxylates (BASF Corp., proprietary ES#8804 identified as a non-thickening polycarboxylate).

| Pre-treatment | | No Pre-treatment Control | | Pre-treatment | |
|---|---|---|---|---|---|
| | | Before Water | After Water | Before Water | After Water |
| Polymer | Sequestrant | Scrub | Scrub | Scrub | Scrub |
| 5% 8804 | none | hard dark gold | not removed | hard dark brown | not removed |
| 5% 8804 | 10% DTPA | hard dark gold | not removed | colorless liquid | fully removed |
| 5% 8804 | 10% EDTA | hard dark gold | not removed | colorless liquid | fully removed |
| 5% 8804 | 10% Na citrate | hard dark gold | not removed | gold liquid | fully removed |
| 5% 8804 | Dequest 2010 | hard dark gold | not removed | colorless liquid | fully removed |
| 5% 8804 | 5% EDTA | hard dark gold | not removed | hard black | fully removed |
| 2.5% 8804 | 10% EDTA | hard dark gold | not removed | colorless liquid | fully removed |
| 5% Acusol 445N | 10% EDTA | hard dark gold | not removed | colorless liquid | fully removed |
| 5% Acusol 445N | none | hard dark gold | not removed | hard dark brown | partially removed |
| 5% Acusol 448 | 10% EDTA | hard dark gold | not removed | colorless liquid | fully removed |
| 5% Acusol 448 | none | hard dark gold | not removed | hard dark brown | partially removed |
| 5% Acusol 460N | 10% EDTA | hard dark gold | not removed | colorless liquid | fully removed |
| 5% Acusol 460N | none | hard dark gold | not removed | hard dark brown | partially removed |

The data demonstrate that use of the polymer or sequestrant alone provides insufficient soil release according to the objectives of the invention. The combination of the polymer and sequestrant does provide adequate soil release with the application of the pretreatment according to the methods and compositions of the invention. Further, the data demonstrate the oleophobic polymer is also a threshold agent and/or is capable of binding the metal iron. Therefore, the oleophobic polymer is able to partially release the soil in the absence of an additional sequestrant.

Example 4

The effect of treatment with the soil release compositions as a combined cleaner and soil release system were tested according to the methods and compositions of the invention. The soil release system of Example 2 was further tested for residual action as a soil release system following its use as a cleaner. A stainless steel panel was divided into two sections. Corn oil was wiped onto both sections of the steel coupon. A paper towel was wetted with the soil release composition of Example 2 and applied to one half of the coupon to remove the corn oil. The first section was not administered the soil release composition (Test One: Control). The second section was administered the soil release composition consisting of the combined polymer/sequestrant/surfactant combination of ES#8804/DTPA/Pluronic 10R5 (Test Two: 22D).

Corn oil was then reapplied to the section of the panel that was cleaned the soil release composition. The coupon was then heated on a hot plate until the control area that hadn't been cleaned turned to a hard dark gold. Both sections of the panel were a hard dark gold at that point in time. Then a paper towel was wetted with water and used to remove the soil from the panels. Neither section of the panel showed any visible soil removal, indicating that the soil release system must be applied to a clean surface.

What is claimed is:

1. A soil release composition for use in removing soils including non-trans fats from pretreated surfaces, consisting of:

(a) a clean solid surface in need of treatment with a soil release composition;

(b) from 1-10% weight of a non-thickening, oleophobic and hydrophilic polymer selected from the group consisting of polyacrylates, olefin/maleic copolymers, polycarboxylates and combinations of the same, from 0-5% weight of a wetting agent, and from 0.5-10% weight of a sequestrant having a stability constant with iron ligands of at least about 5, suitable for use to hinder polymerization of non-trans fat soils on said clean surface and selected from the group consisting of aminocarboxylates, hydroxycarboxylates, organophosphonates and combinations of the same, and wherein said composition forms a soil to composition surface contact angle greater than 20 degrees and has a ratio of oil/water contact angle greater than 2.0.

2. The composition of claim 1, wherein said sequestrant is an aminocarboxylate.

3. The composition of claim 2, wherein said sequestrant has a stability constant with iron ligands of at least about 8.

4. The composition of claim 1, wherein said wetting agent is a surfactant selected from the group consisting of an anionic surfactant, nonionic surfactant and combinations of the same.

5. The composition of claim 4, wherein said surfactant is an ethylene oxide-propylene oxide copolymer.

6. The composition of claim 4, wherein said surfactant is a reverse ethylene oxide-propylene oxide copolymer.

7. The composition of claim 1, wherein said polymer is from about 2-8% weight, said sequestrant is from 1-7% weight and said wetting agent is from about 0.1-3% weight.

8. The composition of claim 7, wherein the pH of said composition is from 3-12.

9. The composition of claim 1, wherein said polymer is from about 2-4% weight, said sequestrant is from 2-5% weight and said wetting agent is from about 0.2-2% weight.

10. A soil release composition for removing non-trans fat soils from surfaces, consisting of:

(a) a clean solid surface in need of treatment with a soil release composition;

(b) from 2-8% weight of a non-thickening, oleophobic and hydrophilic polymer selected from the group consisting of polyacrylates, olefin/maleic copolymers, polycarboxylates and mixtures thereof, from 1-7% weight of a sequestrant having a stability constant with iron ligands of at least about 5 and selected from the group consisting of aminocarboxylates, hydroxycarboxylates, organophosphonates and mixtures thereof, and from 0.1-3% weight wetting agent, wherein said pH of the composition is from 5-11, and wherein said composition forms a soil to composition surface contact angle greater than 20 degrees and has a ratio of oil/water contact angle greater than 2.0.

11. A soil release pretreated surface consisting of:

(a) a clean solid surface for applying a soil release composition to form said soil release pretreated surface; and (b) a layer of soil release composition on said surface for removing non-trans fat soils, said composition consisting of from 1-10% weight of a non-thickening polymer, from 0.5-10% weight of a sequestrant and from 0-5% weight of a wetting agent, wherein said polymer is oleophobic and hydrophilic, and is selected from the group consisting of polyacrylates, olefin/maleic copolymers, polycarboxylates and mixtures thereof; and a sequestrant, wherein said sequestrant has a stability constant with iron ligands of at least about 5 and is selected from the group consisting of aminocarboxylates, hydroxycarboxylates, organophosphonates and mixtures thereof.

12. A method of removing non-trans fat soils from hard surfaces, comprising:

contacting a clean hard surface with a soil releasing composition, said composition consists of from 1-10% weight of a non-thickening, oleophobic and hydrophilic polymer selected from the group consisting of polyacrylates, olefin/maleic copolymers, polycarboxylates and mixtures thereof and from 0.5-10% weight of a sequestrant having a stability constant with iron ligands of at least about 5 and selected from the group consisting of aminocarboxylates, hydroxycarboxylates, organophosphonates and mixtures thereof; and removing said soils.

13. The method of claim 12, wherein said surface is metal.

14. The method of claim 12, wherein said polymer is a polyacrylate.

15. The method of claim 12, wherein said Sequestrant is an aminocarboxylate.

16. The method of claim 12, further comprising removing said soils from said surface with a cleaning article and optionally water.

17. The method of claim 12, further comprising removing said soils from said surface with water alone.

18. The method of claim 12, wherein said soils comprise corn or vegetable oil.

19. The method of claim 12, wherein said composition further comprises a wetting agent selected from the group consisting of a nonionic surfactant, anionic surfactant, EO—PO copolymers and mixtures thereof.

20. The method of claim 12, further comprising contacting a non-trans fat soil to said surface, wherein a contact angle of said non-trans fat soil is greater than 20 degrees and has a ratio of oil/water contact angle greater than 2.0.

* * * * *